United States Patent [19]

Callaway, Jr.

[11] Patent Number: 4,688,795

[45] Date of Patent: Aug. 25, 1987

[54] FOOTBALL LINEMAN TRAINING APPARATUS

[76] Inventor: Robert L. Callaway, Jr., 5490 SW. 128 Ave., Ft. Lauderdale, Fla. 33330

[21] Appl. No.: 849,214

[22] Filed: Apr. 7, 1986

[51] Int. Cl.[4] ..... A63B 67/00

[52] U.S. Cl. ..... 273/55 R

[58] Field of Search ..... 273/55 R; 272/70; 434/251; 182/145, 146, 178, 179, 184

[56] References Cited

U.S. PATENT DOCUMENTS

| | | | |
|---|---|---|---|
| 2,255,710 | 9/1941 | Noor | 273/55 R |
| 2,752,155 | 6/1956 | Nedwick | 273/55 R |
| 3,578,324 | 5/1971 | Coleman | 273/55 R |
| 4,218,060 | 8/1980 | Forrest | 273/55 R |

*Primary Examiner*—Richard C. Pinkham

*Assistant Examiner*—T. Brown

*Attorney, Agent, or Firm*—John Cyril Malloy

[57] ABSTRACT

A training assembly used to teach football players, primarily offensive and defensive interior, down linemen the proper technique and body orientation when moving from an initial, set position into a blocking position. The assembly includes a frame structure fixedly or removably mounted to extend upwardly from a supporting surface over which the player travels wherein the frame structure is particularly configured to define a channel dimensioned to allow the head and worn helmet of a player to pass therealong. Restraining elements define the longitudinal perimeters of the channel and serve as shoulder restraints to prevent the vertical upright orientation of the player as he positions himself from the aforementioned set position into the blocking position.

12 Claims, 7 Drawing Figures

FOOTBALL LINEMAN TRAINING APPARATUS

BACKGROUND OF THE INVENTION

1. Field of the Invention

This invention relates to a training assembly specifically structured and configured to train football players, particularly down lineman, to assume the proper orientation as they move or "fire out" from the set position to the blocking position where the contact is made with players of the opposing team.

2. Description of the Prior Art

In the United States the team sport of football has achieved great popularity and because of such popularity it is currently played at various levels including little league, high school, college, and professional leagues. A young player graduating to the successively higher levels or leagues is dependent upon his skill and ability in comparison with other players. In addition to innate talent of a player, his ability to progress through the sport is also very dependent upon the coaching such player receives during his younger years and as he successfully plays in the various leagues with superior skill.

Coaching, at almost all levels of play, utilizes a variety of training devices for the purpose of improving the player's strength as well as developing certain preferred and recongized techniques for accomplishing the various functions. Such functions or skills needed by a football player, dependent upon the position played, include blocking, tackling, etc. To aid in the teaching of proper technique to football players, devices of the type disclosed in the following U.S. patents are known in the prior art. Such Patents include Nedwick, U.S. Pat. No. 3,451,677; Hornak, U.S. Pat. No. 3,580,574; and Forest, U.S. Pat. No. 4,218,060. In the latter patent to Forest, a portable traing device is disclosed for teaching football lineman the proper technique for gradually raising their bodies from a set position to a blocking position. Accordingly, the prior art recognizes that certain techniques including the orientation and control of the body of the player as it travels from an initial, set position outwardly into a blocking position, must be maintained in a substantially low or partially crouched orientation. However, training devices used to teach players proper orientation or technique in assuming the blocking position have a possible disadvantage in that restraining bars or elements are placed directly over the player's head. Accordingly, if the player inadvertently rises to the level of such retaining elements, a severe blow could be delivered to the head. Even though the head is protected by a conventional helmet structure, a serious blow or repeated blows could cause severe damage which should not be risked particularly when utilizing a training device which is intended to teach proper playing techniques.

Accordingly, there is a need in the prior art for a training assembly specifically structured to maintain and teach proper orientation of a player as he travels from his set position to blocking position by restraining the player into a low or crouched orientation without positioning any type of restraints or structures which could come in contact with the player's head, even though helmeted. Such a preferred device should be capable of being made from any number of a variety of strong and rigid materials so that the device may be portable and transported between numerous sites or easily installed and/or removed before and after practice utilizing such a training assembly.

SUMMARY OF THE INVENTION

The present invention is directed towards a training assembly of the type primarily designed to teach down lineman, both offensive and defensive, the proper technique and body orientation when traveling from an initial set position into a proper blocking position for contact with players of the opposing team. It is well recognized that down linemen should generally maintain a low or semi-crouched attitude as they travel from their initial set position, upon the snapping of the football, into a position where contact is made with an opposing player. If such a low profile is not maintained and if a player assumes a substantially vertically upright stance too soon or prior to making contact with an opposing player, he frequently renders himself almost helpless from the standpoint of preventing himself from being blocked or removed from the play. Accordingly, it is of great importance than the low orientation or semi-crouched position be maintained during the "firing out" of the player upon the snapping of the ball. While players with some experience realize that such a technique and body orientation is preferred and even necessary in certain plays, bad habits frequently develop in such players without their knowledge. Accordingly, there is a need for a training assembly which will allow the player to repeatedly practice the lower crouched orientation as he travels from his initial, set position to a blocking position or to his point of contact with an opposing player.

The training assembly of the present invention comprises a frame means supported above a supporting surface over which the player travels. The frame means includes a plurality of support legs extending upwardly from the supporting surface and either removably or fixedly mounted thereon. The frame means is structured to define a channel extending from an entrance portion of the frame to an exit portion thereof. Such channel generally defines the straight line path of travel of the player as he moves from his set position to his blocking position.

An important feature of the present invention is the provision of a first and a second restraining element disposed in spaced relation to one another and being substantially parallel and further defining the longitudinal perimeters of the channel. The channel and the respective restraining elements are disposed such that if a player rises too fast and attempts to assume a substantially upright vertical orientation, he will be restrained. Such restraint occurs by virtue of his shoulder pads coming in contact with the correspondingly positioned shoulder restraining elements disposed on each side of the channel and above each of the respectively positioned shoulder pads. However, if such inadvertent upright position is assumed, there will be no restraining structure to contact or forceably engage the head of the player. A connecting element is disposed adjacent the respective ends of the restraining element and across the channel. However, this connecting element, being positioned adjacent the exit portion of the frame, serves to interconnect and thereby strengthen the restraining elements. Also, the connecting element has a longitudinal curvilinear configuration so as to rise above and across the channel. This connecting element is thereby dimensioned such as to allow the head and helmet of the player to pass beneath and effectively through the connecting element and out of contact therewith.

In a preferred embodiment of the present invention, to be described in greater detail hereinafter, a distal portion of the restraining element substantially adjacent to the exit portion of the frame means rises at a consistent incline. This configuration allows a slow or gradual rising of the player from his initial set position assumed in a crouched orientation to a partially upright position best for blocking or assuming contact with an opposing player.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed drawings in which.

Like reference numerals refer to like parts throughout the several views of the drawings.

DETAILED DESCRIPTION OF THE PREFERRED EMBODIMENT

Figure 1:
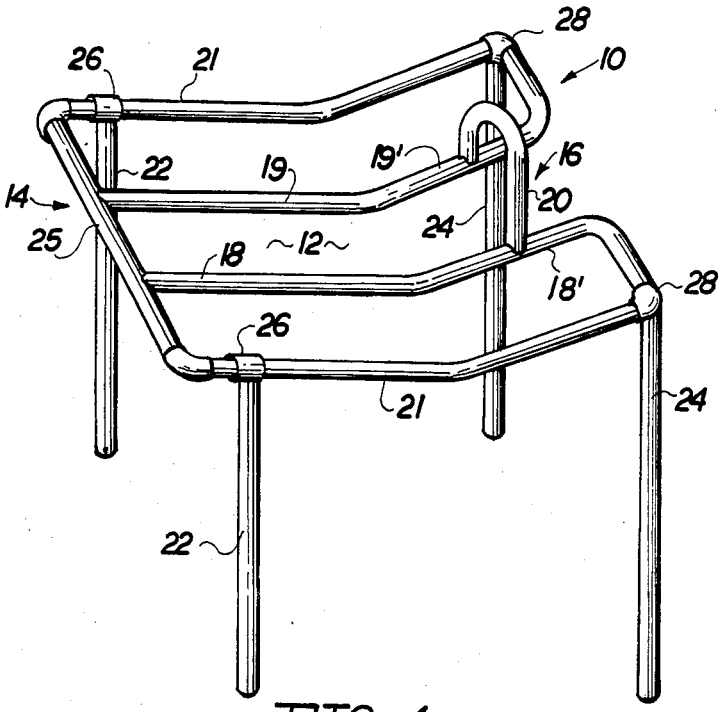
FIG. 1 is an isometric view of the training assembly structured for use by one player at a time.
Figure 2:
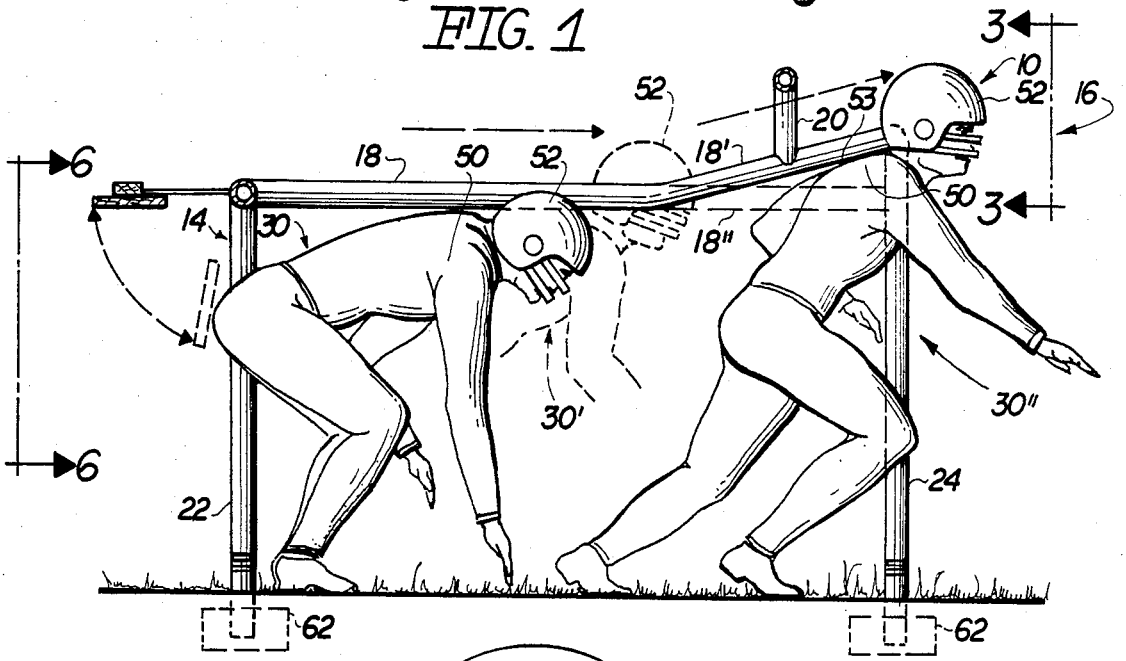
FIG. 2 is a side view of the training assembly of the present invention including various positions of the player as he travels from his initial set and crouched position to his blocking position.

As shown in FIGS. 1 and 2, the present invention relates to a training assembly generally indicated as 10 and structured to include a substantially centrally located, elongated channel 12 formed by a frame means. The frame means includes an entrance portion 14 and an exit portion 16 and the channel 12 extends therebetween. A first restraining element 18 is disposed in spaced, substantially parallel relation to a second restraining element 19 wherein these restraining elements 18 and 19 define the longitudinal perimeters of channel 12 as shown. As will be explained in greater detail hereinafter and particularly with reference to FIG. 2, a player enters the training assembly 10 at the entrance portion 14 and assumes a set position. The structure of the frame means is such as to maintain the player in a preferred, low, crouched orientation until he reaches the exit portion 16 whereat he assumes a blocking position.

Again, with reference to FIG. 1, the frame means further includes a brace means comprising side bars or brace bars 21 disposed in spaced relation to respectively positioned restraining elements 18 and 19 being interconnected to such restraining element at their distal end adjacent the exit portion 16 thereof. In addition, a support means is used to suspend the restraining elements 18 and 19 above a supporting surface 60 (FIG. 2) over which the player travels while utilizing the subject training assembly. The support means includes a plurality of legs 22 and 24 having their lower ends affixed directly to the ground surface 60 or alternately to anchor facilities. Such anchor facilities, as shown in FIG. 2, include an anchor base 62 which may be a block of poured cement. An upstanding segment 64 projects outwardly from the buried anchor base 62 and has means as at 64' for interconnecting the lower ends as at 22' and 24' of the legs 22 and 24 respectively to the upwardly extending segment 64. Such interconnection between the anchor assemblies and the lower ends of the respective legs may be such as to be removable. This allows the frame means to be assembled and removed before and after practice or use. Attachment means 26 and 28 are provided for interconnecting the upper end of the respective plurality of legs 22 and 24 to various portions of the remainder of the frame mean such as along side brace bars 21 or at the junction between the respective restraining elements 18 and 19, at their distal ends, with the side bars 21 as shown in FIG. 1.

Figure 5:
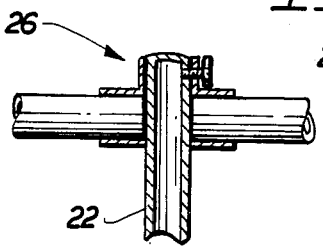
FIG. 5 is a detailed view of means to adjustably interconnect support legs of the assembly to the remainder of the frame to allow variance in the preferred height at which it is utilized.
Figure 5A:
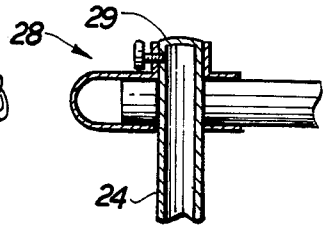

With reference to FIG. 5, substantially conventional connectors 26 and 28 may be utilized to adjustably interconnect the upper ends of the legs 22 and 24 to the remainder of the frame means. This is accomplished by an internally threaded or similarly structured connector member 29 which may selectively travel or be adjusted relative to the longitudinal axis of the leg. This serves to allow adjustability of the height of the restraining elements 18 and 19 as well as certain other segments or portions of the frame means.

Figure 4:
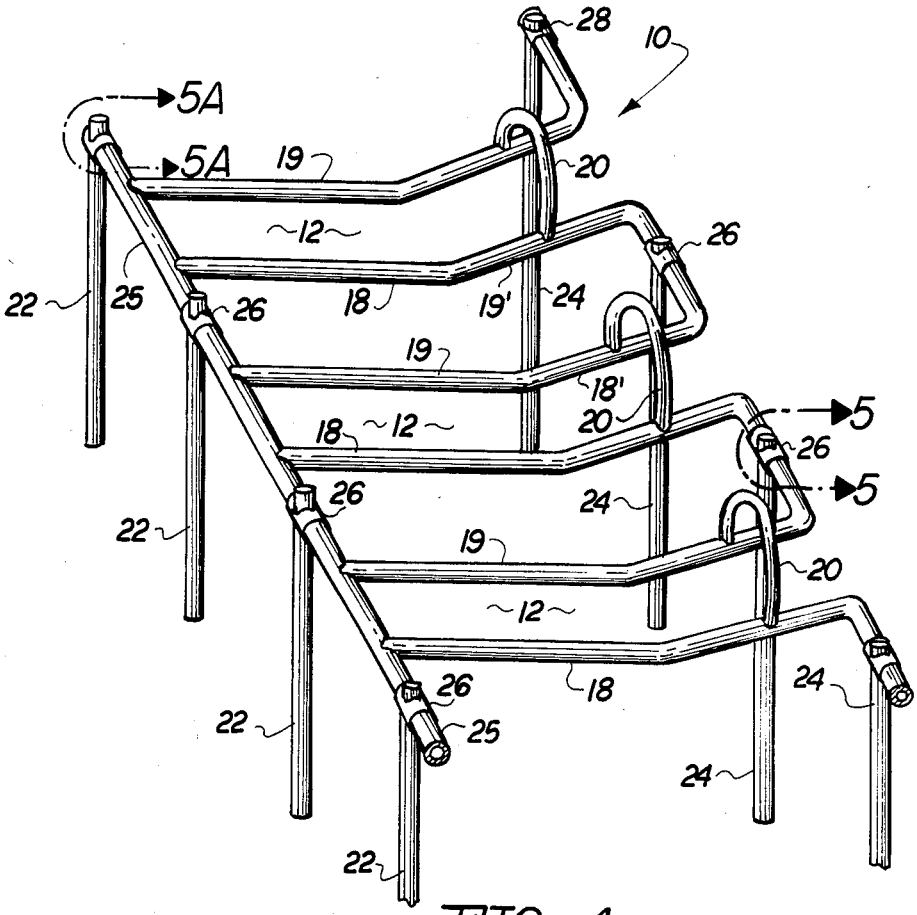
FIG. 4 is an isometric view of a training assembly of the present invention wherein the frame is structured such that a plurality of players such as those representing the down linemen in an offensive or defensive line, can concurrently use the assembly.

As shown best in FIGS. 1, 4 and 5, the brace means further comprises one or more braces 25 serving to interconnect the proximal ends of the restraining elements 18 and 19 in fixed, spaced apart relation to one another. Further, the cross brace 25 extends laterally outward from the respective restraining elements 18 and 19 along its own longitudinal axis into connecting engagement with the side bars 21 as shown in FIG. 1.

Another feature of the embodiment of FIG. 1 is the positioning of the major length of the restraining elements 18 and 19 in a substantially horizontal orientation relative to the supporting surface 60. However, the remaining length 18' and 19' of the restraining elements 18 and 19 is oriented at an upwardly inclined or angular orientation relative to horizontal. This particular orientation allows for the gradual and consistent rising of the player (see FIG. 2) from his semi-crouched position to assume the proper blocking position when reaching the exit portion 16 of the training assembly 10.

Figure 3:
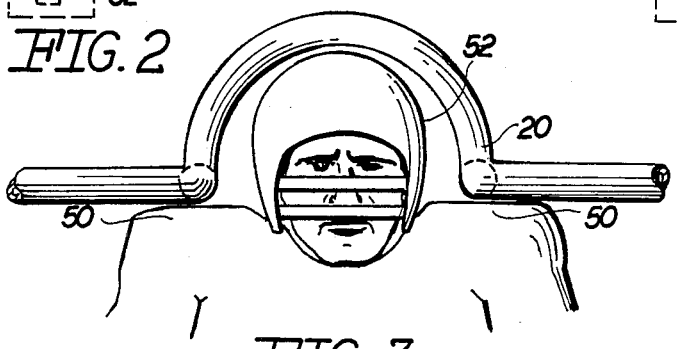
FIG. 3 is a front plan view of the assembly of FIG. 1.

Another feature of the subject training assembly 10 includes a connecting member or element 20 having a substantially arcuate or curvilinear longitudinal configuration and further having its opposite ends fixedly secured to the respective restraint elements 18 and 19 at a position substantially adjacent the exit portion 16 of the training assembly 10. The connecting element 20 is provided to brace the restraining elements 18 and 19 relative to one another as well as to maintain their fixed, spaced relation to one another. At the same time the connecting element is configured and dimensioned to extend out of any interruptive engagement relative to the head or helmet of the player. With reference to FIGS. 2 and 3, the connecting element 20 rises above and across the channel 12 a sufficient distance so as to allow the head or helmet 52 of the player 30 to pass beneath. However, the restraining elements 18 and 19 are specifically disposed and configured to be in restraining position relative to the upward positioning or rising of the shoulder pads 50 of the player 30. With reference to FIG. 2, the player initially assumes a set position as indicated generally at 30 at the entrance portion 14 of the training assembly 10. As the player moves forward, he is restrained from passing beyond the semi-crouched position represented as 30' in that his shoulder pads 50 will engage the correspondingly positioned restraining elements 18 and 19 as he rises to their height. However, even at this height the head or helmet 52 will not engage any restraining element or obstruction and therefore will not receive any inadvertent blows which could cause injury to the player. As the player reaches the position 30' which may be defined as the blocking position, he assumes at least a partially upright position and is allowed to raise his shoulders and upper body due to the inclined orientation of the portions 18' and 19' of the respective restraining elements. At the point of contact 53 between shoulder pads 50 and the restraining elements 18 and 19, the maximum upright position of the player has been achieved. Still the helmet has not come into contact with any restraining element. As set forth above, the connecting element 20 (see FIG. 3) is sufficiently dimensioned to allow the helmet 52 of the head of the player to pass therethrough.

FIGS. 4 and 5 represent another embodiment of the present invention wherein a plurality of players, preferably at least 5, can concurrently use the training assembly and each is provided with a separate chananel 12 through which the head may pass. The structure of the training assembly 10' having combined and aligned in substantially parallel channels 12 is specifically structured such that all of the down linemen represent an offensive and/or defensive line may concurrently use the assembly and travel therethrough in synchronized movement so as to simulate actual game conditions.

Figure 6:
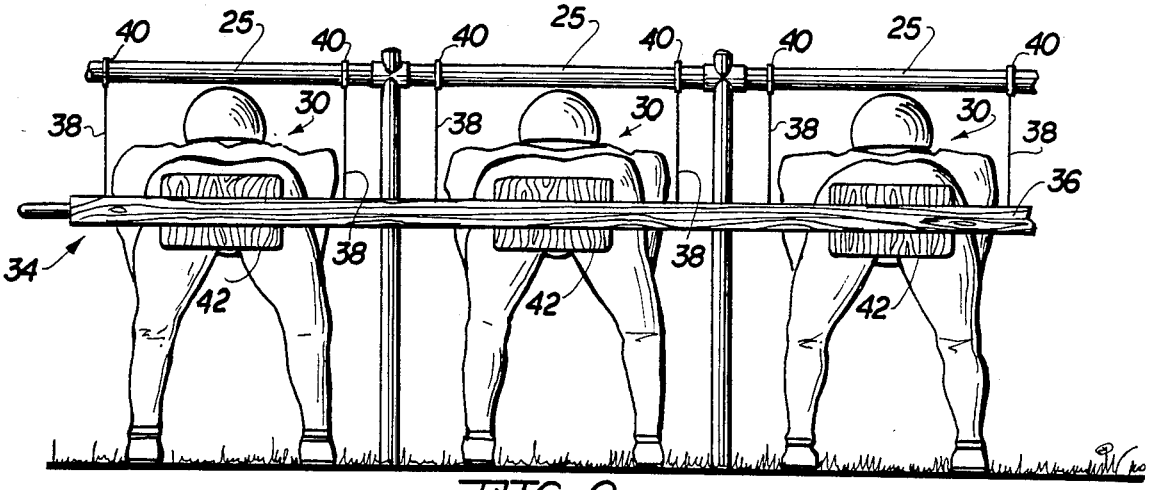
FIG. 6 is a rear view of the assembly further including a starting structure used for one or more players incorporated thereon.

In order to further facilitate such synchronized movement of a plurality of players, a starting assembly generally inidcated as 34 is provided. Such starting assembly includes an elongated shaft or mounting element 36 having a plurality of player engaging paddles or segments 42 affixed thereto in spaced relation along the length thereof. The mounting element 36 is secured as at 38 to the cross brace 25 of each of the respective channels wherein the cross braces 25 are disposed in coaxially, aligned relation to one another. Hooks or rings 40 serve to interconnect members 38 to the mounting element 36 and further serve to allow movement of the element in a rotational manner about the longitudinal axis of the aligned cross braces 25. In operation, the mounting element 36 is raised above the plurality of players shown in their set position 30 in FIG. 6. Once raised to the beginning or ready position, the element 36 is dropped thereby serving to provide concurrent contact of the paddle elements 32 with the rear of the players causing them to simultaneously move forwardly from their set position 30 to their blocking position 30'' (see FIG. 2).

It should be noted that a similarly structured starting means 34 could be used in combination with the training assembly 10 as shown in FIG. 1. In such embodiment, the single player using the channel 12 would pass therethrough upon being contacted by a single paddle element 42.

What is claimed is:

1. A training assembly of the type primarily designed for the training of football players, particularly offensive and defensive down linemen, said training assembly comprising:

(a) a frame means for maintaining proper orientation of a player from and between an initially, set position to a blocking position, (b) said frame means including an entrance portion and an exit portion disposed to respectively define a locale of a player in said set position and said blocking position, (c) a channel extending substantially the length of said frame means between said entrance portion and said exit portion and being open at said exit portion, (d) said channel defined at least in part by a first restraining element and a second restraining element each disposed in spaced relation to one another and extending the length of said channel between said entrance portion and said exit portion, (e) said restraining elements defining opposite longitudinal perimeters of said channel and being spaced apart a distance sufficient to allow passage of a player's head therebetween and along the length of said channel, (f) said restraining elements disposed in spaced, substantially parallel relation to one another and positioned to engage a uniformed player's shoulder pads upon rising thereof and structured to restrain the player from upright orientation beyond a height of said restraining elements, (g) said restraining elements each extending from said entrance portion along a majority of said channel length in a substantially horizontal orientation and further extending upwardly from said horizontal orientation to said exit portion, and (h) support means for securing said frame means above a supporting surface over which the player travels.

2. A training assembly as in claim 1 wherein said frame means is portable and removably secured in upstanding relation to the supporting surface, said supporting means comprising a plurality of legs each having an elongated configuration and being secured at their respective upper ends to a remainder of said frame means and removably secured at the respective lower ends to the supporting surface.

3. A training assembly as in claim 2 wherein said support means further comprises an anchor assembly fixedly secured to the supporting surface and removably attached to at least one of said legs of said support means.

4. A training assembly as in claim 1 wherein each of said restraining elements comprises a correspondingly positioned distal end disposed adjacent said exit portion, said open end at said exit portion disposed at a height above said supporting surface sufficient to allow at least a partially upright orientation of a player into said blocking position.

5. A training assembly as in claim 4 further comprising a connecting element attached in interconnecting relation to each of said first and second restraining elements and substantially across said channel, said connecting element disposed and configured for nonobstructing disposition relative to a player's head travelling along said channel when positioned between said restraining elements.

6. A training assembly as in claim 5 wherein said connecting element is fixedly attached to end of said restraining elements at opposite ends of said connecting element, said connecting element having a substantially curvilinear configuration along its length and extending above and across said channel in transverse relation to the length thereof.

7. A training assembly as in claim 1 further comprising a starting assembly secured to said frame means adjacent said entrance portion thereof, said starting assembly positionable between a ready position and a starting position, said starting position defined by contact with a player oriented in said set position at said entrance portion of said frame means.

8. A training assembly as in claim 1 wherein said support means comprises a plurality of legs each having an elongated configuration and being secured at their respective upper end to said frame means, attachment means for securing the upper end of said plurality of legs to said frame means and being structured for variable positioning of said frame means along the longitudinal axis of said plurality of legs adjacent said respective upper ends thereof.

9. A training assembly as in claim 1 further comprising brace means disposed in interconnecting relation between corresponding positioned ends of said restraining elements adjacent said entrance portion, said brace means structured for fixed positioning of said restraining elements in spaced apart relation to one another.

10. A training assembly as in claim 7 wherein a plurality of channels are disposed in spaced apart, aligned and substantially parallel relation to one another, said brace means associated with each channel and being connected to the respective restraining elements thereof, whereby each of a plurality of players may concurrently use respective channels in a synchronized manner.

11. A training assembly of the type primarily designed for the training of football players, particularly offensive and defensive down linemen, said training assembly comprising:

(a) a frame means for maintaining proper orientation of a player from and between an initially, set position to a blocking position, (b) said frame means including an entrance portion and an exit portion disposed to respectively define a locale of a player in said set position and said blocking position, (c) a channel extending substantially the length of said frame means between said entrance portion and said exit portion and being open at said exit portion, (d) said channel defined at least in part by a first and a second restraining element disposed in spaced relation to one another and extending the length of said channel between said entrance portion and said exit portion, (e) said restraining elements defining opposite longitudinal perimeters of said channel and being spaced apart a distance sufficient to allow passage of a player's head therebetween along the length of said channel, (f) said restraining elements each disposed to engage a uniformed player's shoulder pads upon rising thereof and structured to restrain the player from upright orientation beyond a height of said restraining elements, (g) a connecting element attached in interconnecting relation to each of said first and second restraining elements adjacent said exit portion and substantially across said channel, said connecting element disposed and configured for non-obstructing disposition relative to a player's head travelling along said channel when positioned between said restraining elements, (h) said connecting element being fixedly attached to each of said restraining elements at opposite ends of said connecting element and said connecting element having a substantially curvilinear configuration along its length and extending above and across said channel in transverse relation to the length thereof, and (i) support means for securing said frame means above a supporting surface over which the player travels.

12. A training assembly of the type primarily designed for the training of football players, particularly offensive and defensive down linemen, said training assembly comprising:

(a) a frame means for maintaining proper orientation of a player from and between an initially, set position to a blocking position, (b) said frame means including an entrance portion and an exit portion disposed to respectively define a locale of a player in said set position and said blocking position, (c) a channel extending substantially the length of said frame means between said entrance portion and said exit portion and being open at said exit portion, (d) said channel defined at least in part by a first and a second restraining element disposed in spaced relation to one another and extending the length of said channel between said entrance portion and said exit portion, (e) said restraining elements defining opposite longitudinal perimeters of said channel and being spaced apart a distance sufficient to allow passage of a player's head therebetween along the length of said channel, (f) said restraining elements each disposed to engage a uniformed player's shoulder pads upon rising thereof and structured to restrain the player from upright orientation beyond a height of said restraining elements, (g) a starting means for activating a player into motion, said starting means movably secured to said frame means adjacent said entrance portion thereof and selectively positionable between a ready position and a starting position, said starting position defined in part by contact of starting means with a player disposed at said entrance portion, and (h) support means for securing said frame means above a supporting surface over which the player travels.

* * * * *